US008449252B2

(12) United States Patent
Van Otten Tolman

(10) Patent No.: US 8,449,252 B2
(45) Date of Patent: May 28, 2013

(54) DOUBLE-STACKED BLADE CEILING FAN AND METHOD OF OPERATION AND METHOD OF CIRCULATING AIR

(75) Inventor: Angela Lynn Van Otten Tolman, Allen, TX (US)

(73) Assignee: Craftmade International, Inc., Coppell, TX (US)

( * ) Notice: Subject to any disclaimer, the term of this patent is extended or adjusted under 35 U.S.C. 154(b) by 606 days.

(21) Appl. No.: 12/687,551

(22) Filed: Jan. 14, 2010

(65) Prior Publication Data

US 2011/0171021 A1 Jul. 14, 2011

(51) Int. Cl.
*F04D 3/00* (2006.01)

(52) U.S. Cl.
USPC ..... 416/1; 416/5; 416/128; 416/201 A; 416/201 R

(58) Field of Classification Search
USPC ..... 416/5, 124, 128, 198 R, 201 R, 1
See application file for complete search history.

(56) References Cited

U.S. PATENT DOCUMENTS

| | | | | |
|---|---|---|---|---|
| 829,333 | A | 8/1906 | Hampson | |
| 1,548,326 | A | 8/1925 | McDuffie | |
| 1,661,882 | A | 3/1928 | Derrick | |
| 1,682,856 | A | 9/1928 | Salkind | |
| 1,805,508 | A | 5/1931 | Angelillo | |
| 2,001,467 | A | 5/1935 | Madigan | |
| 2,350,962 | A * | 6/1944 | Hays | 416/124 |
| 2,952,787 | A * | 9/1960 | Moore | 310/157 |
| 3,083,893 | A | 4/1963 | Dean | |
| D224,431 | S | 7/1972 | Keegan | |
| D309,818 | S | 8/1990 | Bink | |
| 5,228,651 | A | 7/1993 | Warner | |
| D340,974 | S | 11/1993 | Davis, Jr. | |
| D343,491 | S | 1/1994 | Cusimano | |
| D350,888 | S | 9/1994 | Perry | |
| D396,926 | S | 8/1998 | Underhill et al. | |
| 5,931,640 | A * | 8/1999 | Van Houten et al. | 416/128 |
| 6,053,477 | A | 4/2000 | Price | |
| D428,986 | S | 8/2000 | Dye | |
| D430,931 | S | 9/2000 | Dye | |
| D434,491 | S | 11/2000 | Nourse | |
| D435,900 | S | 1/2001 | Dye | |
| D437,075 | S | 1/2001 | Chen | |
| D437,927 | S | 2/2001 | Dye | |

(Continued)

OTHER PUBLICATIONS

Declaration of Justin Wills Under 37 C.F.R. 1.132 with exhibits filed in co-pending U.S. Appl. No. 29/338,065 on Apr. 8, 2010.

(Continued)

*Primary Examiner* — Edward Look
*Assistant Examiner* — Christopher R Legendre
(74) *Attorney, Agent, or Firm* — Bracewell & Giuliani LLP

(57) ABSTRACT

An embodiment of a ceiling fan assembly has a motor rotatably mounted to a shaft and adapted to be mounted to an extent of a substantially planar support surface. A first set of fan blades are connected to the motor and a second set of fan blades are connected to the shaft a predetermined distance below the extent of the substantially planar support surface, the motor, and the first set of fan blades. A method of circulating air comprises driving the motor to drive the first set of blades in a first rotational direction about the shaft. Simultaneously, responsive to the air flow generated by the rotation of the first set of blades in a first rotational direction, the second set of blades rotates in a second rotational direction about the shaft, opposite the first rotational direction.

21 Claims, 9 Drawing Sheets

U.S. PATENT DOCUMENTS 6,220,906 B1 * 4/2001 Dubois ..... 440/81
6,244,820 B1 6/2001 Yilmaz
D465,841 S 11/2002 Dye
6,537,019 B1 * 3/2003 Dent ..... 415/61
6,565,334 B1 * 5/2003 Bradbury et al. ..... 417/423.1
D479,595 S 9/2003 Curtin
D479,596 S 9/2003 Curtin
D479,597 S 9/2003 Curtin
D479,873 S 9/2003 Curtin
D479,875 S 9/2003 Curtin
D480,129 S 9/2003 Curtin
D480,134 S 9/2003 Wilson
D480,465 S 10/2003 Wilson
D481,453 S 10/2003 Dye
D481,789 S 11/2003 Dye
D482,116 S 11/2003 Curtin
D491,261 S 6/2004 Curtin
D492,056 S 6/2004 Curtin
6,761,144 B2 * 7/2004 Schwam ..... 123/242
D498,019 S 11/2004 Dye
6,817,830 B1 11/2004 Chen
D499,829 S 12/2004 Curtin
D500,879 S 1/2005 Curtin
D501,059 S 1/2005 Curtin
D501,948 S 2/2005 Curtin
D503,490 S 3/2005 Curtin
D503,824 S 4/2005 Curtin
D503,992 S 4/2005 Curtin
D503,995 S 4/2005 Curtin
D504,059 S 4/2005 File et al.
D507,050 S 7/2005 Curtin
D508,125 S 8/2005 Curtin
D508,126 S 8/2005 Curtin
D508,991 S 8/2005 Young
D511,000 S 10/2005 Young
6,968,953 B2 11/2005 Humphrey
D513,819 S 1/2006 Ji
D514,242 S 1/2006 Curtin
D514,243 S 1/2006 Curtin
D514,244 S 1/2006 Curtin
D514,694 S 2/2006 Young
D515,686 S 2/2006 Young
D522,131 S 5/2006 Dye
D522,132 S 5/2006 Dye
D522,644 S 6/2006 Curtin
D523,949 S 6/2006 Curtin
D527,092 S 8/2006 Dye
D528,198 S 9/2006 Dye
D528,647 S 9/2006 Dye
D530,004 S 10/2006 Curtin
D532,101 S 11/2006 Curtin
D532,106 S 11/2006 Curtin
D536,438 S 2/2007 Curtin
D537,605 S 2/2007 Rivera
D544,132 S 6/2007 Curtin
D548,874 S 8/2007 Curtin
D549,381 S 8/2007 Curtin
D551,382 S 9/2007 Curtin
D553,285 S 10/2007 Curtin
D553,785 S 10/2007 Dye
D553,786 S 10/2007 Dye
D556,318 S 11/2007 Curtin
D556,887 S 12/2007 Curtin
D556,888 S 12/2007 Curtin
D556,889 S 12/2007 Curtin
D556,890 S 12/2007 Brookins
D556,891 S 12/2007 Brookins
D556,944 S 12/2007 Brookins
D557,400 S 12/2007 Curtin
D557,793 S 12/2007 Curtin
D557,794 S 12/2007 Curtin
D563,033 S 2/2008 Brookins
D563,034 S 2/2008 Curtin
D563,592 S 3/2008 Brookins
D567,357 S 4/2008 Curtin
D567,358 S 4/2008 Curtin
D567,359 S 4/2008 Teiber et al.
D567,360 S 4/2008 Curtin
D571,909 S 6/2008 Curtin
D573,246 S 7/2008 Teiber et al.
D584,397 S 1/2009 Curtin
D585,974 S 2/2009 Curtin
D598,090 S 8/2009 Pittman et al.
D602,149 S 10/2009 Curtin
D602,150 S 10/2009 Curtin
D602,151 S 10/2009 Curtin
D602,152 S 10/2009 Dye
D602,581 S 10/2009 Dye
D602,672 S 10/2009 Stillwell
D603,499 S 11/2009 Curtin
D603,953 S 11/2009 Brookins
D603,954 S 11/2009 Curtin
D603,955 S 11/2009 Patton
D603,956 S 11/2009 Curtin
D604,406 S 11/2009 Patton
D604,407 S 11/2009 Patton
D606,187 S 12/2009 Curtin
D632,002 S 2/2011 Dye
D636,297 S 4/2011 Wu et al.
D661,792 S * 6/2012 VanOtten Tolman ..... D23/377
2005/0249598 A1 * 11/2005 Young ..... 416/198 R
2007/0297911 A1 12/2007 Brookins
2009/0163056 A1 6/2009 Brookins et al.
2011/0171021 A1 * 7/2011 VanOtten Tolman ..... 416/1

OTHER PUBLICATIONS

U.S. Appl. No. 29/376,805, filed Oct. 12, 2010, First Name Inventor Angela Lynn VanOtten Tolman.

U.S. Appl. No. 29/338,065; Notice of Allowance and Fees Due; Mailed on Jan. 12, 2011.

* cited by examiner

DOUBLE-STACKED BLADE CEILING FAN AND METHOD OF OPERATION AND METHOD OF CIRCULATING AIR

CROSS REFERENCE TO RELATED APPLICATIONS

This application is a continuation-in-part application which claims the benefit of and priority to U.S. Design Patent Application No. 29/338,065, filed on Jun. 3, 2009, and herein incorporated by reference in its entirety.

FIELD OF THE INVENTION

The present invention relates to the field of interior housing fixtures, and, more particularly, to a ceiling fan with two independent sets of blades.

BACKGROUND OF THE INVENTION

Ceiling fans are well known as effective means for circulating air in enclosed spaces. They are employed chiefly in warm weather conditions for cooling and ventilating rooms. Ceiling fans are usually centered on the ceiling of a room and are typically operated to push air downward in the center of a room. In other words, the fan blades move in a counterclockwise direction, thereby resulting in the downward movement of air closer to the center of the fan, and an upward movement of air away from the center of the fan.

Certain ceiling fans may be fitted with a switch that switches the direction of the fan blades to a clockwise direction, i.e., they are reversible. This can help push the warmer air that is typically trapped near the ceiling back down into a room away from the center of the fan, thus "de-stratifying" the layers of warm air. As a result, the warm air is circulated to the floor of the room where it is needed, and the heating system does not overwork to warm the room.

Ceiling fans in the prior art typically comprise a single reversible motor that is capable of directing the flow of air in one of two directions at any given time depending on the rotational direction of the fan blades. In these fans, the reversible motor is mounted to a mounting rod and drives a central hub. Typically, a plurality of fan blades is coupled to and rotatable with, the central hub. Therefore, a ceiling fan whose blades are rotating in a counterclockwise direction will push air downward closer to the center of the fan, while a ceiling fan that is rotating in a clockwise direction will push air downward away from the center of the fan.

SUMMARY OF THE INVENTION

Applicant has recognized a need for more aesthetically pleasing ceiling fans, ceiling fans that have a nice visual appearance and yet do not require significantly more energy to operate than traditional ceiling fan assemblies. Additionally, applicant has recognized a need for a ceiling fan that is capable of simultaneously circulating air in two different directions.

An embodiment of the ceiling fan assembly of this invention includes a motor rotatably mounted on a shaft. The shaft has an axis extending a substantial length thereof. The motor is positioned to rotate about the axis of the shaft. A first set of fan blades are connected to the motor and are positioned to rotate in a first rotational direction relative to the shaft when the motor operates. A second set of fan blades are rotatably connected to the shaft a predetermined direction from the motor along the shaft. The second set of fan blades are positioned to rotate in a second rotational direction relative to the shaft, simultaneously with and in response to air currents generated by rotation of the first set of blades in the first rotational direction.

An embodiment of the ceiling fan assembly of this invention includes a motor positioned to rotate about an axis. A motor housing is connected to and simultaneously rotatable with the motor about the axis. A first set of fan blades are connected to and have portions thereof extending radially and outwardly through the motor housing. The first set of fan blades are positioned to rotate in a first rotational direction relative to the axis when the motor operates. A blade housing is positioned below the motor housing and rotatable about the axis. A second set of fan blades are connected to and have portions thereof extending radially and outwardly through the blade housing. The blade housing and the second set of fan blades are positioned to rotate in a second rotational direction relative to the axis and opposite to the first rotational direction responsive to air currents generated by rotation of the first set of blades in the first rotational direction when the motor operates and simultaneous with the first set of fan blades rotating in the first rotational direction.

An embodiment of this invention is directed to a method of circulating air. The method comprises positioning a ceiling fan assembly. The ceiling fan assembly has a first set of fan blades connected to a shaft and a second set of fan blades rotatably connected to the shaft a predetermined distance from the first set of fan blades along the shaft. The first set of fan blades are rotated in a first rotational direction relative to the shaft, thereby generating air currents. Responsive to the air currents generated by rotation of the first set of blades in the first rotational direction when the motor operates, the second set of fan blades are rotated in a second rotational direction relative to the shaft and opposite to the first rotational direction and simultaneous with the first set of fan blades rotating in the first rotational direction.

An embodiment of this invention is directed to a method of driving a ceiling fan assembly. The ceiling fan assembly has a motor rotatably mounted to a shaft, the shaft having an axis extending at least a substantial length thereof, a first set of fan blades connected to the motor, and a second set of fan blades rotatably connected to the shaft a predetermined distance below the motor and the first set of fan blades along the shaft. The ceiling fan assembly is mounted to an extent of a substantially planar support surface, such that the axis of the shaft is substantially perpendicular to a horizontal plane of the extent of the substantially planar support surface. The motor is operated to rotate the first set of fan blades in a first rotational direction relative to the axis, thereby generating air currents. Responsive to the air currents generated by rotation of the first set of blades in the first rotational direction when the motor operates, the second set of fan blades is simultaneously rotated in a second rotational direction relative to the shaft and opposite to the first rotational direction.

BRIEF DESCRIPTION OF THE DRAWINGS

So that the manner in which the features and benefits of the invention, as well as others which will become apparent, may be understood in more detail, a more particular description of the invention briefly summarized above may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

DETAILED DESCRIPTION

The present invention now will be described more fully hereinafter with reference to the accompanying drawings in which a preferred embodiment of the invention is shown. This invention may, however, be embodied in many different foams and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
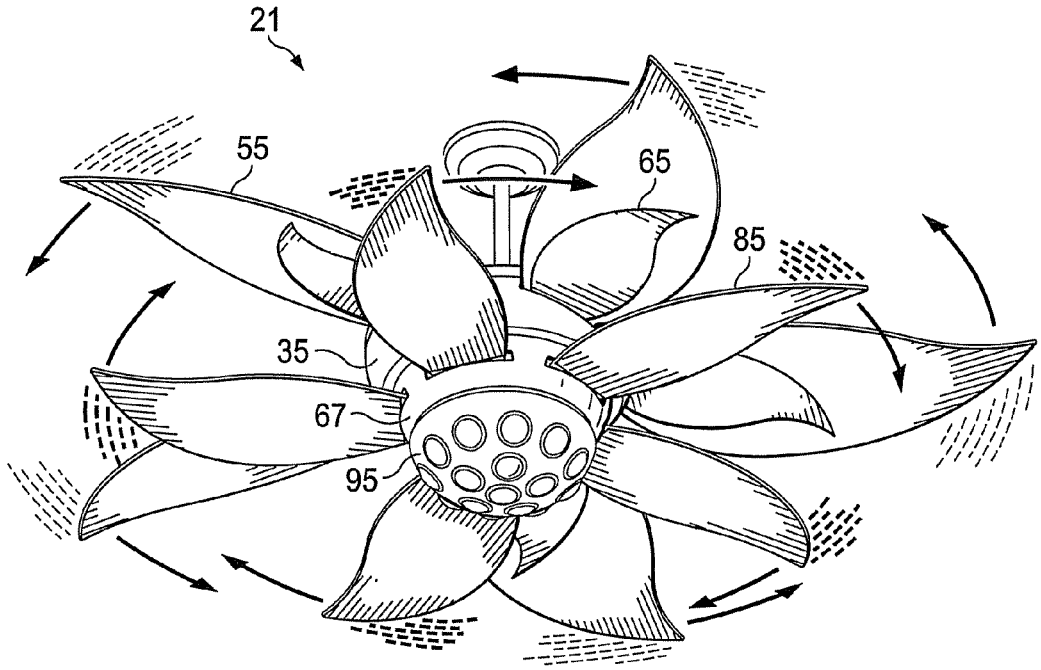
FIG. 1 is a perspective view of a ceiling fan assembly according to an embodiment of the present invention.

FIG. 1 illustrates a ceiling fan assembly 21 as comprised by an embodiment of the present invention. The ceiling fan assembly 21 is adapted to be mounted to a ceiling surface for circulating air in a desired space. Although the ceiling fan assembly 21 may be mounted to numerous support surfaces with different horizontal and vertical orientations, for purposes of explanation and example, the support surface referred to hereinafter will be a support surface of a preferred embodiment. In the preferred embodiment, the ceiling fan assembly 21 is connected to a substantially planar support surface 23 extending in a substantially horizontal plane defining a ceiling surface, as best seen in FIGS. 2 and 6-9.

Figure 2:
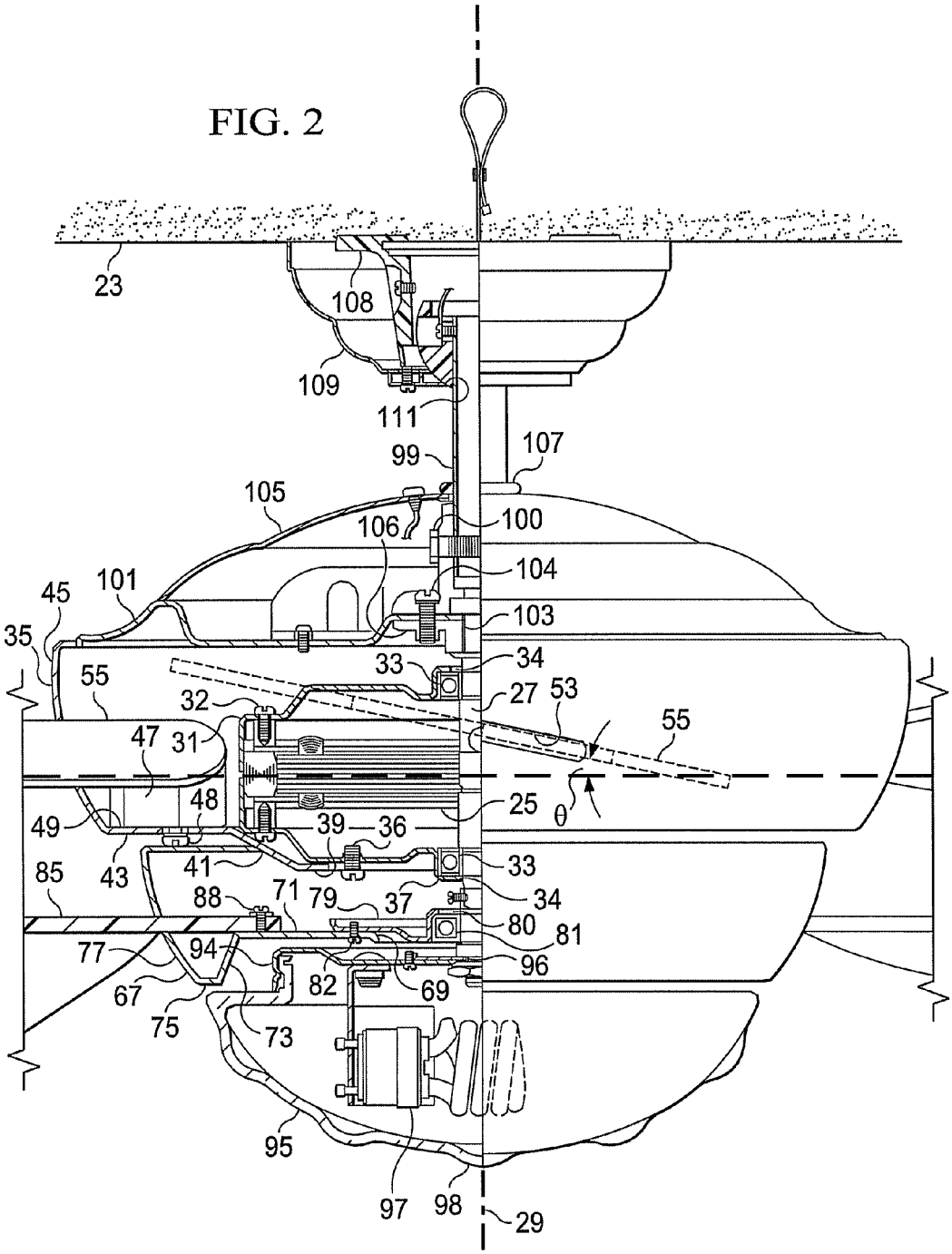
FIG. 2 is a cross-sectional view of the ceiling fan assembly of FIG. 1.

Ceiling fan assembly 21 has a motor 25 that is rotatably mounted to a shaft 27 as best illustrated in FIG. 2. In this embodiment, the shaft 27 is cylindrical and has an axis 29 substantially extending along its length. In the preferred embodiment, the axis 29 is adapted to be positioned substantially perpendicular to the substantially planar support surface 23 when the ceiling fan assembly 21 is mounted thereon. The motor 25 is electrically coupled to a power source (not shown) and a power switch (not shown) that allows the motor 25 to receive electrical power when switched on, thereby rotating the motor about the axis 29. The motor 25 is connected to and enclosed within a motor casing 31. In this embodiment, motor 25 is connected to motor casing 31 by way of fasteners 32. The motor casing 31 has centrally located annular openings, 34 on its upper and lower surfaces through which the shaft 27 extends. The motor casing 31 is rotatably connected to the shaft 27 by way of bearings 33. Bearings 33 are positioned on the shaft 27 near the annular openings 34 on the upper and lower surfaces of the motor casing 31. Bearings 33 allow the motor 25 and motor casing 31 to simultaneously rotate about the axis 29 as it remains stationary. Motor casing 31 is connected to and positioned within a motor housing 35. In this particular embodiment, motor casing 31 is connected to motor housing 35 by way of fasteners 36. Motor housing 35 has a centrally located annular opening 37 extending through a generally planar and horizontal support flange 39. Shaft 27 extends axially through annular opening 37. Support flange 39 extends concentrically outward from opening 37. Support flange 39 transitions to an upwardly tapered flange 41. Flange 41 transitions to a flange 43 that is substantially parallel to and in a plane located at a higher elevation than the support flange 39. Flange 43 transitions to a flange 45 that extends outwardly and upwardly from flange 43 before ending. An annular area exists between the inner surface of flange 45 and the outer surface of motor casing 31. It is important to note that motor housing 35 may have different geometric shapes and configurations in additional embodiments.

Figure 3:
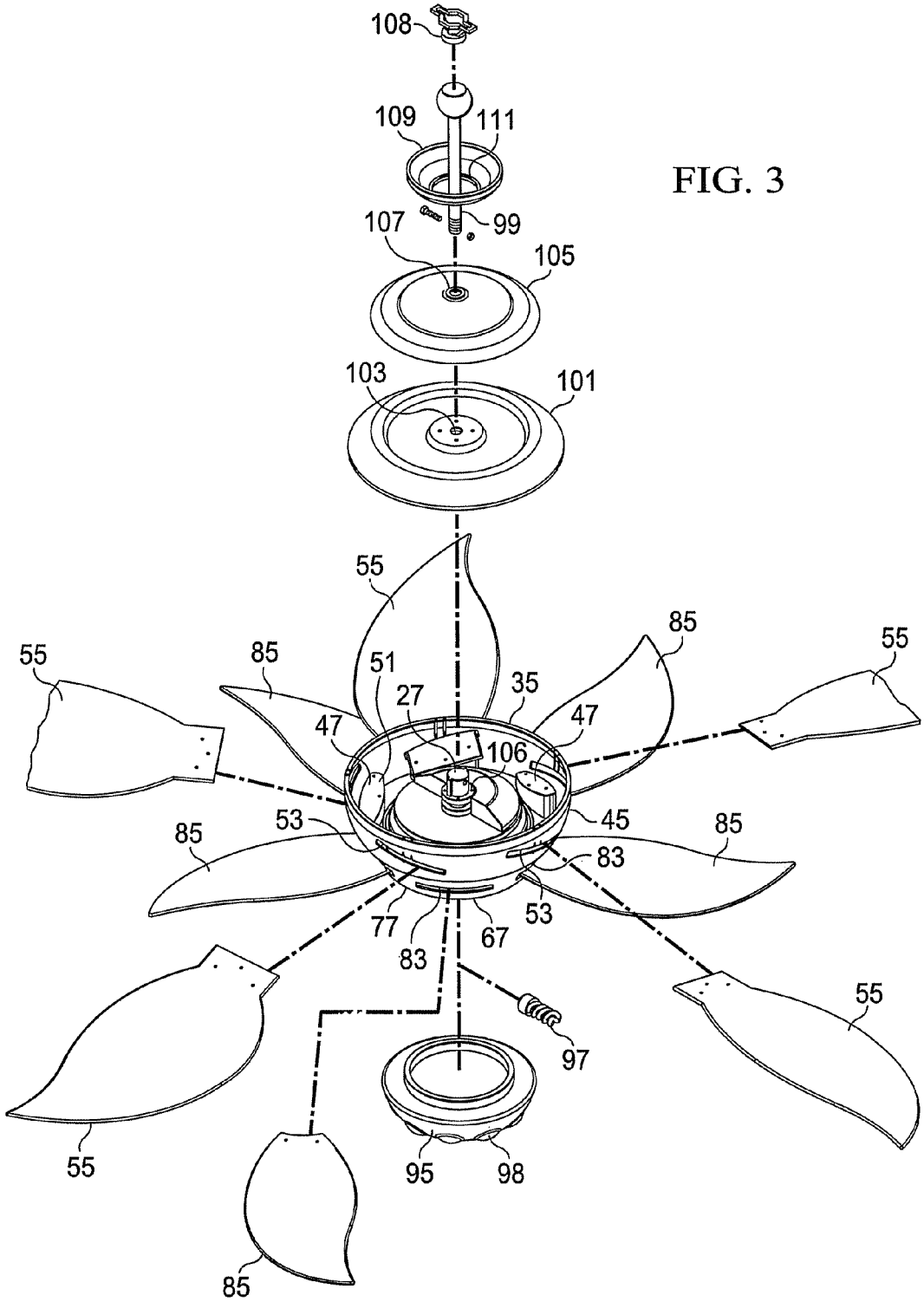
FIG. 3 is an exploded view of the ceiling fan assembly of FIG. 1.
Figure 4:
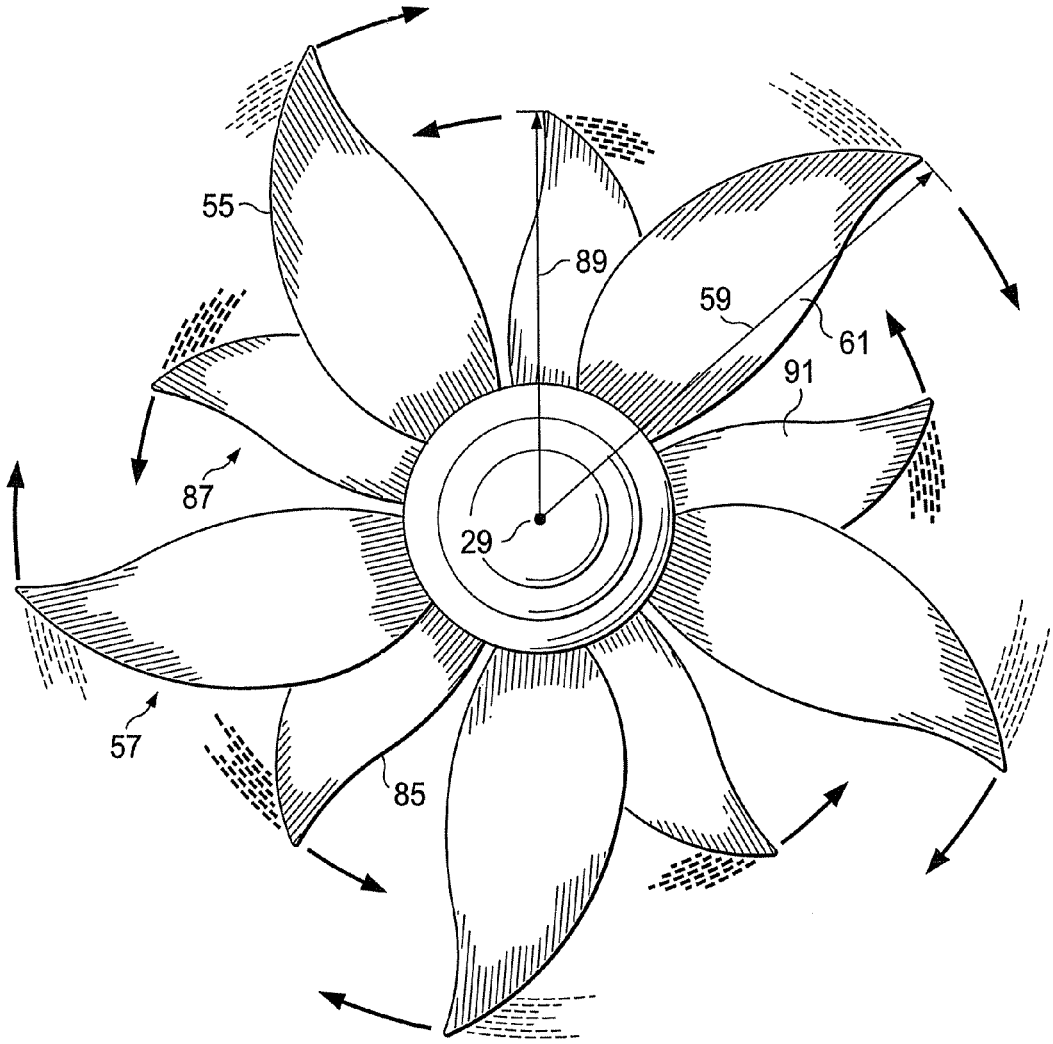
FIG. 4 is a top plan view of the ceiling fan assembly of FIG. 1.
Figure 5:
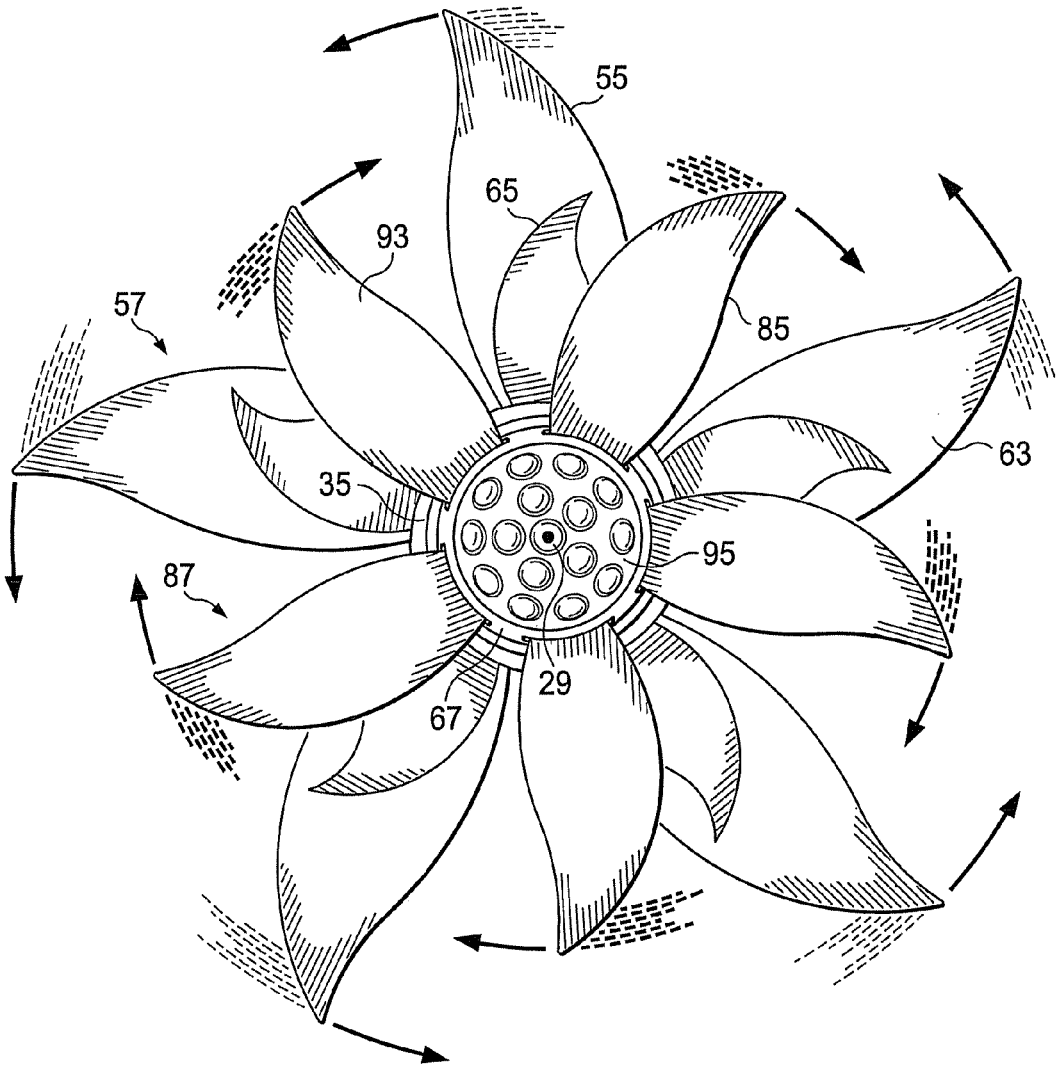
FIG. 5 is a bottom plan view of the ceiling fan assembly of FIG. 1.
Figure 6:
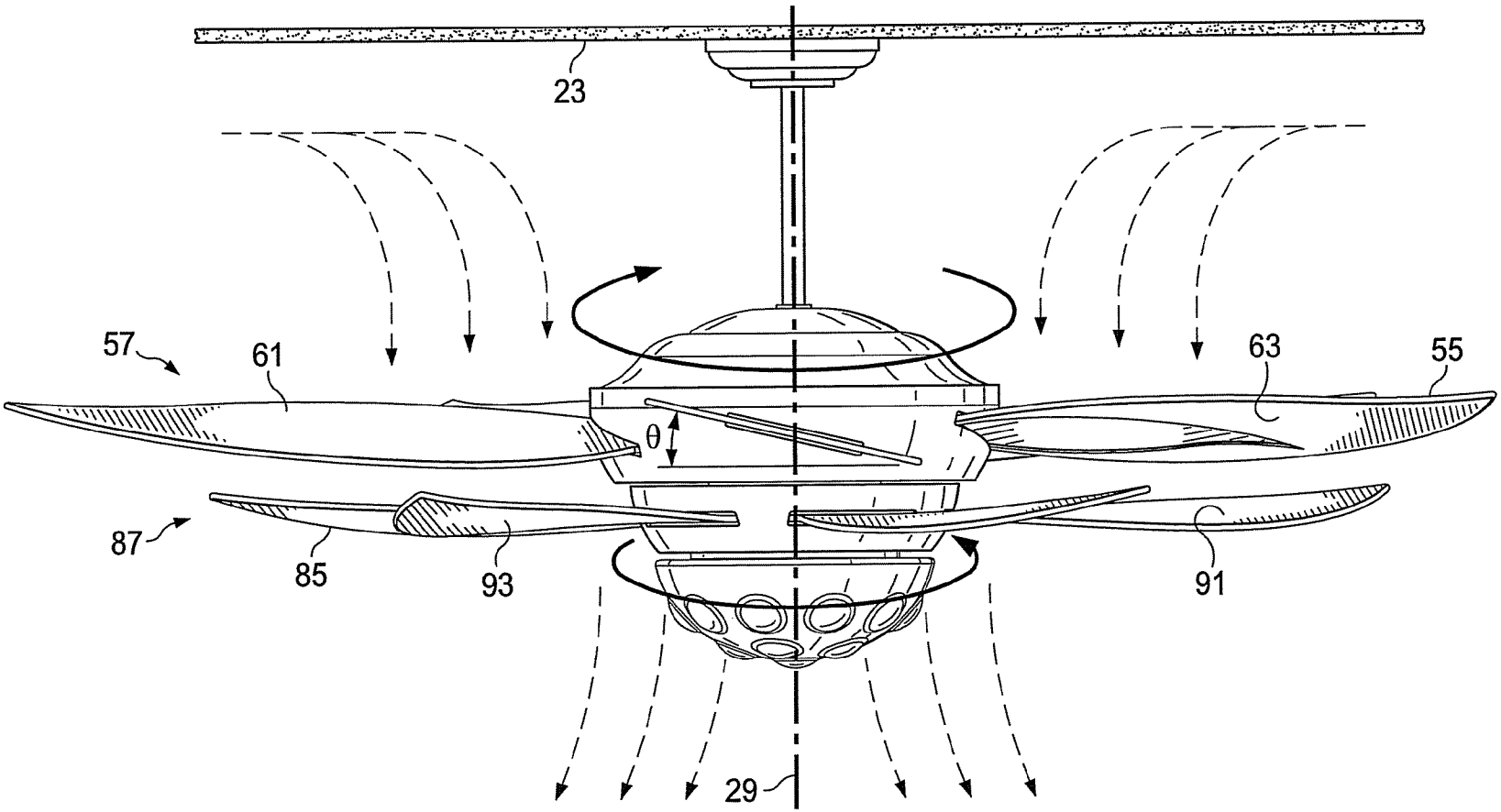
FIG. 6 is a side elevational view of the ceiling fan assembly of FIG. 1, with the first set of blades rotating in a clockwise direction when viewed from below.
Figure 8:
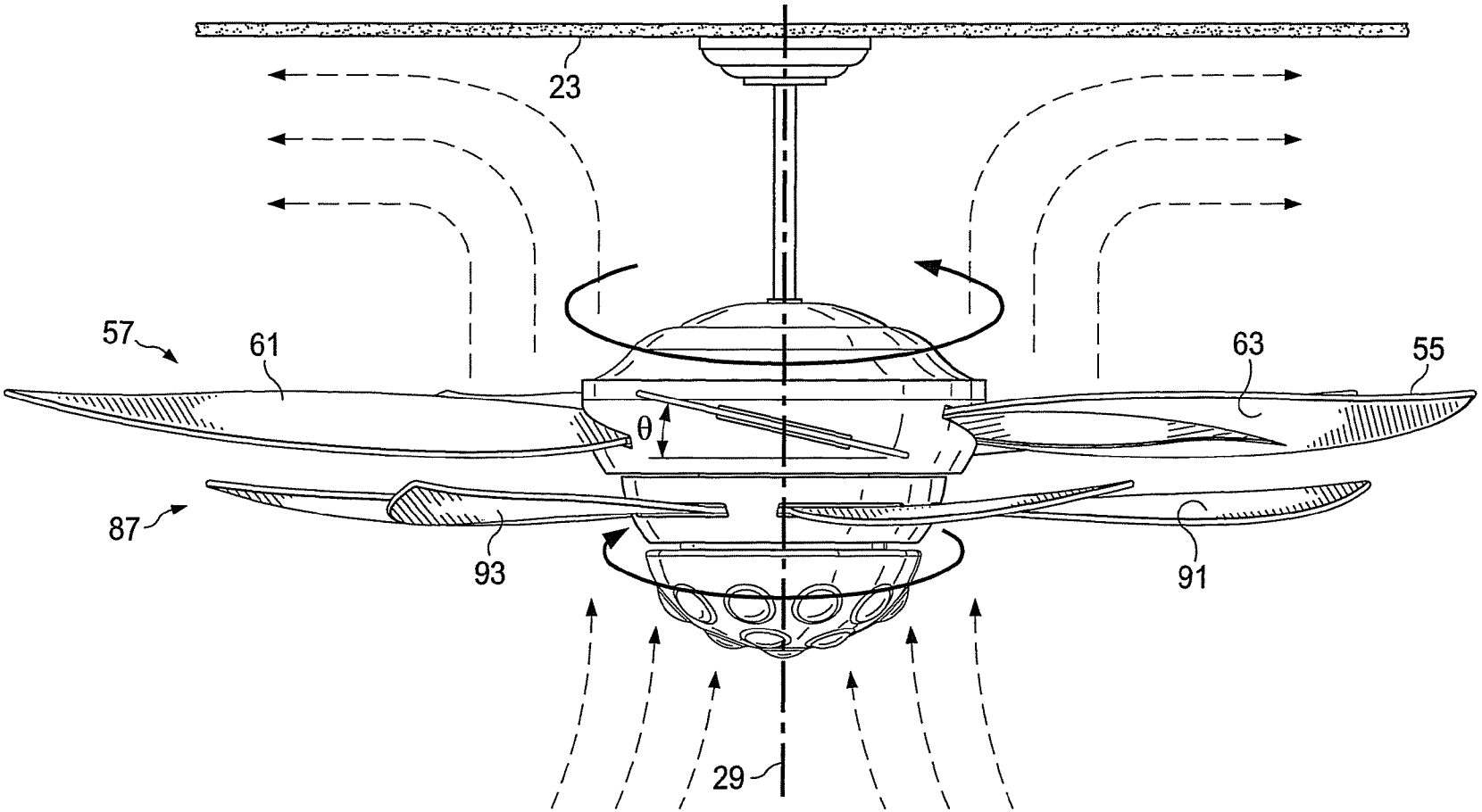
FIG. 8 is a side elevational view of the ceiling fan assembly of FIG. 1, with the first set of blades rotating in a counter-clockwise direction when viewed from below.

In an embodiment, a plurality of blade adapters 47, as best illustrated in FIG. 3, are connected to and in abutting contacting with the inner surface of flange 43 of motor housing 35. In an alternate embodiment, blade adapters 47 may be formed as an integral part of motor housing 35. Blade adapters 47 are positioned at evenly spaced intervals around the axis 29. In this embodiment, five blade adapters 47 are positioned seventy-two (72) degrees apart from one another about the axis 29, in the annular area between the inner surface of flange 45 and motor casing 31, and are connected to motor housing 35 by way of fasteners 48. Each blade adapter 47 has a lower surface 49 (FIG. 2), an upper surface 51, and a body extending therebetween. The lower surface 49 of each blade adapter 47 is substantially planar, parallel to, and in abutting contact with flange 43 (FIG. 2). The upper surface 51 of each blade adapter 47 is planar and is positioned at an angle to the substantially planar support surface 23. A plurality of slots or apertures 53 are located in and extend through flange 45 of motor housing 35. In this embodiment, a fan blade 55 is connected to and in abutting contact with the upper surface 51 of each blade adapter 47 and extends radially and outwardly therefrom through each aperture 53 in flange 45 of motor housing 35 to define a first set of fan blades 57. Each fan blade 55 is connected to blade adapter 47 by way of a fasteners (not shown), but in alternate embodiments, other means of attachment may be employed. As best illustrated in FIGS. 2, 6, and 8, due to the angled upper surface 51 of each blade adapter 47, each fan blade 55 is positioned at an angle θ to the substantially planar support surface 23, to obtain the desired air flow when the first set of blades 57 is rotated about the axis 29. As best illustrated in FIG. 4, each blade 55 of the first set of blades 57 extends a length 59 radially and outwardly from the axis 29. Each blade 55 has an upper blade surface 61 and a lower blade surface 63, the upper blade surface 61 being positioned closer to the substantially planar support surface 23 than the lower blade surface 63, as best illustrated in FIGS. 4-6, and 8. A portion of the lower blade surface 63 of each blade 55 is in abutting contact with the upper surface 51 of each corresponding blade adapter 47. Each blade 55 of the first set of blades 57 has an outer perimeter shaped to have a substantial appearance of a pedal of a flower when viewed from below as best seen in FIG. 5. The lower blade surface 63 of each blade 55 of the first set of blades 57 has a blade indicia 65 formed thereon. The blade indicia 65 has an outer perimeter such that the outer perimeter has a substantial appearance of a pedal of a flower when viewed from below, as best seen in FIG. 5.

The motor 25, motor casing 31, motor housing 35, blade adapters 47, and each blade 55 of the first set of fan blades 57 are connected to one another such that they simultaneously rotate about the axis 29.

A blade housing 67 is positioned a predetermined distance below the motor housing 35 and is rotatably mounted to the shaft 27, as best illustrated in FIG. 2. In this particular embodiment, blade housing 67 has a centrally located annular opening 69 extending through a generally planar and horizontal support flange 71. Shaft 27 extends axially through annular opening 69 in flange 71. Support flange 71 extends concentrically outward from opening 69. Support flange 71 transitions to a downwardly tapered flange 73. Flange 73 transitions to a flange 75 that is substantially parallel to and in a plane located at a lower elevation than the support flange 71. Flange 75 transitions to a flange 77 that extends outwardly and upwardly from flange 75 before ending. Blade housing 67 is connected to the shaft 27 by way of a connector flange 79. The connector flange 79 has a centrally located annular opening 80, through which the shaft 27 extends. Support flange 71 of blade housing 67 is connected to and in abutting contact with a portion of the connector flange 79. In this embodiment, blade housing 67 is connected to connector flange 79 by way of fasteners 82. The connector flange 79 is rotatably connected to shaft 27 by a bearing 81 that is positioned on the shaft 27, below the motor housing 35. Bearing 81 allows the connector flange 29 and bade housing 67 to rotate about the shaft 27, while it remains stationary. It is important to note that blade housing 67 may have different geometric shapes and configurations in additional embodiments.

Figure 7:
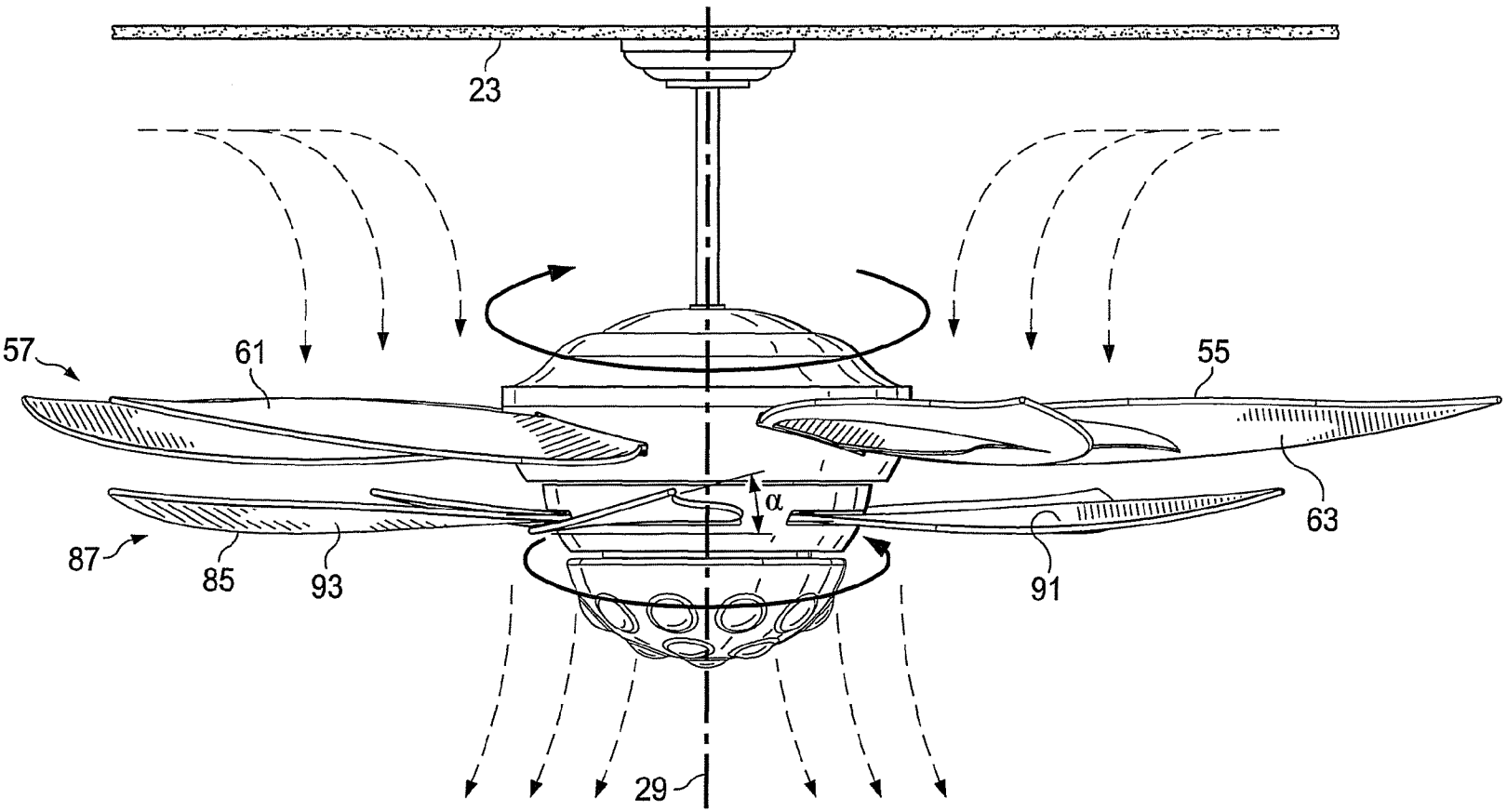
FIG. 7 is an additional side elevational view of the ceiling fan assembly of FIG. 6.
Figure 9:
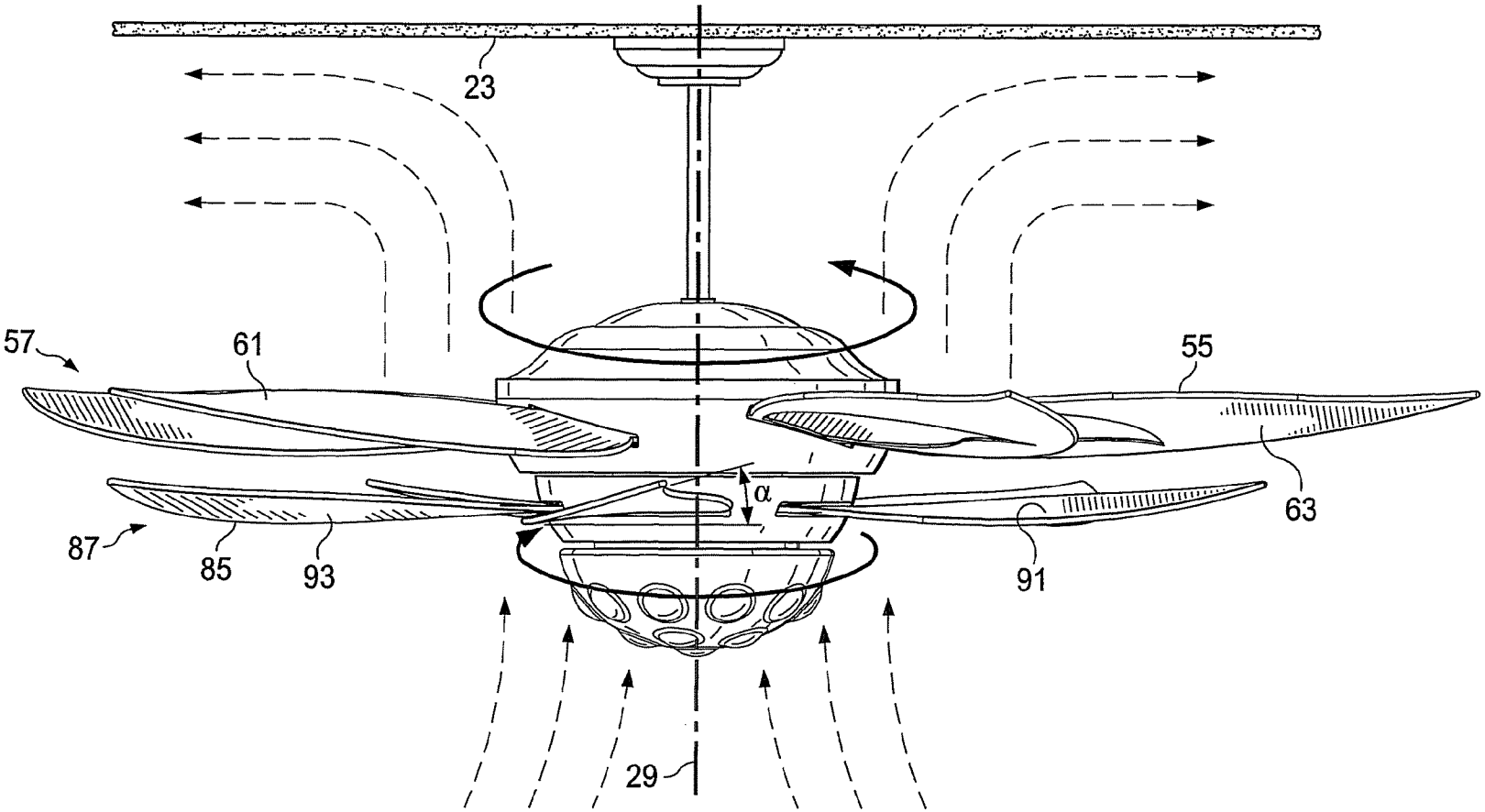
FIG. 9 is an additional side elevational view of the ceiling fan assembly of FIG. 8.

A plurality of slots or apertures 83 are located in and extend through flange 77 of blade housing 67 at evenly spaced intervals around the axis 29 as best illustrated in FIG. 3. In this embodiment five apertures 83 are evenly spaced around the axis 29. Apertures 83 in blade housing 67 are vertically offset from the apertures 53 in the motor housing 35. A fan blade 85 is connected to the inner surface of support flange 71 of blade housing 67 and extends radially and outwardly therefrom through each aperture 83 in flange 77 of blade housing 67 to define a second set of fan blades 87. In this embodiment, each blade 85 of the second set of fan blades 87 is connected to the blade housing 67 by way of fasteners 88. As best illustrated in FIGS. 7 and 9, after each fan blade 85 passes through blade housing 67, the portion of each fan blade 55 extending radially and outwardly from each aperture 83 is angled at an angle $\alpha$ to the substantially planar support surface 23. The angle $\alpha$ is substantially equivalent to the negative angle of $\theta$, meaning that the first set of blades 57 are angled with a substantially negative slop relative to the substantially planar support surface 23 and the second set of blades 87 are angled with a substantially positive slope relative to the substantially planar support surface 23 as best illustrated in FIGS. 2 and 6-9. The first set of blades 57 and the second set of blades 87 are oriented in such a manner so that air flow generated by the rotation of the first set of blades 57 in a first rotational direction relative to the axis 29 causes the second set of blades 87 to rotate in a second rotational direction, opposite the first rotational direction, relative to the axis 29.

As best illustrated in FIG. 4, each blade 85 of the second set of blades 87 extends a length 89 radially and outwardly from the axis 29. The length 89 of the second set of blades 87 is less than the length 59 of the first set of blades 57. Each blade 85 has an upper blade surface 91 and a lower blade surface 93, the upper blade surface 91 being positioned closer to the substantially planar support surface 23 than the lower blade surface 93, as best illustrated in FIGS. 4-5, 7, and 9. Each blade 85 of the second set of blades 87 has an outer perimeter shaped to have a substantial appearance of a pedal of a flower when viewed from below as best seen in FIG. 5. The shape of each blade 85 of the second set of blades 87 is a smaller, substantially mirror image of the shape of each blade 55 of the first set of blades 57, such that when viewed from below, the ceiling fan assembly 21 has the appearance of a blooming flower. As best illustrated in FIG. 2, in this embodiment, the blade housing 67 extends radially and outwardly from axis 29 a lesser distance than motor housing 35. As a result, when viewed from below, the blade housing 67 and second set of blades 87 appear as though they are an inner set of smaller flower pedals, while the motor housing 35 and the first set of blades 57 appear as though they are an outer set of larger flower pedals. The difference in vertical orientation between the first set of blades 57 and the second set of blades 87 relative to the substantially planar support surface 23, the shape of the first set of blades 57 and the second set of blades 87, and the blade indicia 65 on each blade 55 of the first set of blades 57 gives the ceiling fan assembly 21 added depth and visual enhancement when viewed from below, as best illustrated in FIG. 5. The blade housing 67, connector flange 79, and each blade 85 of the second set of fan blades 87 are connected to one another such that they simultaneously rotate about the axis 29.

A light globe 95 is connected in a stationary manner to the lower end of shaft 27, below the motor housing 35 and the blade housing 67, as best illustrated in FIG. 2. In this embodiment, the light globe 95 is threadably connected to a globe connector flange 94. Connector flange 94 has a centrally located annular opening 96 that shaft 27 extends through. Connector flange 94 is connected to shaft 27 in a fixed and stationary manner. In this embodiment, as illustrated in FIG. 5, the light globe 95 is hemispherical in shape, and has a plurality of smaller hemispherical bodies 98 protruding outwardly from the surface of the globe 95. In the embodiment, the light globe 95 is shaped to have a substantial appearance of a tubular floret portion, or center portion, of a flower such as a daisy, when viewed from below. A light source 97 is encased within the light globe 95. In an alternate embodiment, the light globe 95 may be rotatably connected to the lower end of the shaft 27. Not all embodiments of the ceiling fan assembly 21 comprise a light source 97.

The upper end of shaft 27 is connected to a support rod 99, thereby connecting the support rod 99 to the ceiling fan assembly 21. In this embodiment, support rod 99 is cylindrical and is threaded into shaft 27 and further secured by means of a fastener 100. A connector flange 106 extends radially and outwardly from the outer peripheries of the upper end of the shaft 27. A fan housing 101 has an annular opening 103 through which the upper end of the shaft 27 extends. The fan housing 101 is connected to the support flange 106 of the shaft 27, above the motor housing 35, thereby connecting the fan housing 101 to the ceiling fan assembly 21. In this embodiment, fan housing 101 is connected to support flange 106 by way of fasteners 104. A coupler cover 105 has an annular opening 107 through which the support rod 99 extends. The coupler cover 105 is positioned above and in abutting contact with fan housing 101. The coupler cover 105, in conjunction with the fan housing 101, although both fixed relative to the axis 29, give the ceiling fan assembly 21 a look of continuity. The support rod 99 extends axially and upwardly from the shaft 27 before connecting to a mounting bracket 108. The mounting bracket 108 is securely connected to the substantially planar support surface 23, thereby connecting the fan assembly 21 to the substantially planar support surface 23. The mounting bracket 108 may contain electrical connections that transmit power to the ceiling fan assembly 21 and facilitate its operation. The mounting bracket 108 is encased within and connected to a ceiling canopy 109 that has an annular opening 111 through which the support rod 99 extends. The upper end of ceiling canopy is in abutting contact with the substantially planar support surface 23.

In operation, the motor 25 is switched on and rotates in a first rotational direction about the axis 29, for example, a counter-clockwise direction when viewed from below, as best illustrated in FIGS. 5-7. Simultaneously, the motor casing 31, motor housing 35, blade adapters 47, and each blade 55 of the first set of fan blades 57 rotate in a first rotational direction about the axis 29. As illustrated by the dotted lines and arrows of FIGS. 6 and 7, the rotation of the first set of blades 57 causes air above the first set of blades 57 to be forced downwards. As the air flowing downwards contacts the upper blade surface 91 of each blade 85 of the second set of fan blades 87, the wind exerts a force on the upper blade surface 91 that causes the second set of fan blades 87 to simultaneously rotate in a second rotational direction about the axis 29, opposite the first rotational direction of the first set of blades 57, a clockwise direction when viewed from below as best illustrated in FIGS. 5-7. The rotation of the second set of fan blades 87 opposite the direction of the first set of fan blades 57 is also attributed to the angle $\alpha$ at which each blade 85 of the second set of blades 87 is positioned relative to the substantially planar support surface 23. Since $\alpha$ is the negative equivalent of the angle $\theta$, the angle at which each blade 55 of the first set of blades 57 is positioned relative to substantially planar support surface 23, the air flows effects on the second set of blades 87 is opposite that of the first set of blades 57. The blade housing 67, connector flange 79, and each blade 85 of the second set of fan blades 87 are connected to one another such that they simultaneously rotate in the second rotational direction about the axis 29. The simultaneous rotation of the first set of fan blades 57 and the second set of fan blades 87 in opposite directions about the axis 29, gives the appearance of a blooming flower when viewed from below, as best illustrated in FIG. 5.

The direction of rotation of the first set of fan blades 57 can be controlled by a switch located on the fan and connected to the motor (not shown). Assuming that the direction of rotation of the first set of fan blades 57 is reversed, in operation, the motor 25 is switched on and rotates in a first rotational direction about the axis 29, for example, a clockwise direction when viewed from below, as best illustrated in FIGS. 8 and 9. Simultaneously, the motor casing 31, motor housing 35, blade adapters 47, and each blade 55 of the first set of fan blades 57 rotate in a first rotational direction about the axis 29. As illustrated by the dotted lines and arrows of FIGS. 8 and 9, the rotation of the first set of blades 57 causes air below the first set of blades 57 to be drawn upwards. As the air flowing upwards contacts the lower blade surface 93 of each blade 85 of the second set of fan blades 87, the wind exerts a force on the lower blade surface 91 that causes the second set of fan blades 87 to simultaneously rotate in a second rotational direction about the axis 29, opposite the first rotational direction of the first set of blades 27, a counter-clockwise direction when viewed from below as best illustrated in FIGS. 8 and 9. The rotation of the second set of fan blades 87 opposite the direction of the first set of fan blades 57 is also attributed to the angle $\alpha$ at which each blade 85 of the second set of blades 87 is positioned relative to the substantially planar support surface 23. Since a is the negative equivalent of the angle $\theta$, the angle at which each blade 55 of the first set of blades 57 is positioned relative to substantially planar support surface 23, the air flows effects on the second set of blades 87 is opposite that of the first set of blades 57. The blade housing 67, connector flange 79, and each blade 85 of the second set of fan blades 87 are connected to one another such that they simultaneously rotate in the second rotational direction about the axis 29. The simultaneous rotation of the first set of fan blades 57 and the second set of fan blades 87 in opposite directions about the axis 29, gives the appearance of a blooming flower when viewed from below.

The embodiments of the present invention offer several advantages over other ceiling fan assemblies. By providing two independent sets of ceiling fan blades, stacked atop one another, and angled negative to one another relative to a substantially planar support surface, the ceiling fan assembly of the present invention allows for air to be circulated simultaneously in two directions. Additionally, the circulation of the air in two directions is accomplished with only one motor, as the air flow generated by the rotation of the motor driven blades drives the non-motor driven blades, thereby reducing any electrical energy needed to rotate the non-motor driven blades. Furthermore, by shaping the ceiling fan blades to resemble flower pedals, including, blade indicia on one set of the blades, positioning one set of the blades at a higher elevation than the other, extending one set of blades radially and outwardly from the axis further than the other, and employing a light globe that resembles the center of a flower, the ceiling fan assembly when viewed from below is aesthetically pleasing and during operation enhancingly provides a substantially blooming flower appearance.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as set forth in the following claims.

That claimed is:

1. A ceiling fan assembly, the assembly comprising:

a motor positioned to rotate about an axis;

a motor housing connected to and simultaneously rotatable with the motor about the axis;

a first set of fan blades connected to and having at least portions thereof extending radially and outwardly through the motor housing and positioned to rotate in a first rotational direction relative to the axis when the motor operates;

a blade housing positioned below the motor housing and rotatable about the axis; and a second set of fan blades connected to and having at least portions thereof extending radially and outwardly through the blade housing and positioned to rotate in a second rotational direction relative to the axis and opposite to the first rotational direction when the motor operates and simultaneous with the first set of fan blades rotating in the first rotational direction so that air currents generated during operation of the first set of blades when being driven by the motor and rotating in the first rotational direction responsively causes simultaneous rotation of the second set of blades in the second rotational direction.

2. A ceiling fan assembly as defined in claim 1, wherein the first set of blades extend radially outward from the axis a greater distance than the second set of blades.

3. A ceiling fan assembly as defined in claim 1, wherein:

the axis is substantially perpendicular to a horizontal plane of an extent of a substantially planar support surface when the ceiling fan assembly is mounted to the extent of the substantially planar support surface.

4. A ceiling fan assembly as defined in claim 3, wherein each blade of the first set of blades has a blade body including an upper blade surface and a lower blade surface, the upper blade surface being positioned closer to the extent of the substantially planar support surface than the lower blade surface when the ceiling fan assembly is mounted thereto, the lower blade surface extending in a plane positioned at a preselected angle less than 90 degrees to the horizontal plane, and wherein each blade of the second set of blades has a blade body including an upper blade surface and a lower blade surface, the lower blade surface of each blade of the second set of blades being positioned at a preselected angle less than 90 degrees to the horizontal plane and substantially negative to the preselected angle of each blade of the first set of blades so that air current generated during operation of the first set of blades when being driven by the motor and rotating in the first rotational direction responsively causes simultaneous rotation of the second set of blades in the second rotational direction.

5. A ceiling fan assembly as defined in claim 4, wherein the lower surface of each blade of the first set of blades has blade indicia formed thereon so that the simultaneous rotation of the first and second sets of blades of the ceiling fan assembly when mounted to the extent of the substantially planar support surface and during operation enhancingly provides a substantially blooming flower appearance, the blade indicia having an outer perimeter so that the outer perimeter has a substantial appearance of a pedal of a flower, each of the blades of the first set of fan blades and each of the blades of the second set of fan blades having an outer perimeter shaped also to have a substantial appearance of a pedal of a flower.

6. A ceiling fan assembly, the assembly comprising:

a shaft having an axis extending at least a substantial length thereof;

a motor rotatably mounted to the shaft;

a first set of fan blades connected to the motor and positioned to rotate in a first rotational direction relative to the axis when the motor operates; and a second set of fan blades rotatably connected to the shaft a predetermined distance from the motor along the shaft and positioned to rotate in a second rotational direction relative to the axis and opposite to the first rotational direction so that air currents generated during operation of the first set of blades when being driven by the motor and rotating in the first rotational direction responsively cause simultaneous rotation of the second set of blades in the second rotational direction.

7. A ceiling fan assembly as defined in claim 6, wherein:

the axis of the shaft is substantially perpendicular to a horizontal plane of an extent of a substantially planar support surface when the motor and the shaft are mounted to the extent of the substantially planar support surface;

the first set of fan blades are positioned at a lower elevation than the extent of the substantially planar support surface when the motor and shaft are mounted thereto; and the second set of fan blades are positioned at a lower elevation than the first set of fan blades and the extent of the substantially planar support surface when the motor and the shaft are mounted to the extent of the substantially planar support surface.

8. A ceiling fan assembly as defined in claim 7, wherein each blade of the first set of blades has a blade body including an upper blade surface and a lower blade surface, the upper blade surface being positioned closer to the extent of the substantially planar support surface when the motor and shaft are mounted thereto than the lower blade surface, the upper blade surface extending in a plane positioned at a preselected angle less than 90 degrees to the horizontal plane, and wherein each blade of the second set of blades has a blade body including an upper blade surface and a lower blade surface, the upper blade surface of each blade of the second set of blades being positioned to underlie the lower blade surface of each blade of the first set of blades during operation, the lower blade surface of each blade of the second set of blades being positioned at a preselected angle less than 90 degrees to the horizontal plane and substantially negative to the preselected angle of each blade of the first set of blades.

9. A ceiling fan assembly as defined in claim 8, wherein the lower surface of each blade of the first set of blades has blade indicia formed thereon so that the simultaneous rotation of the first and second sets of blades of the ceiling fan assembly when mounted to the extent of the substantially planar support surface and during operation enhancingly provides a substantially blooming flower appearance, the blade indicia having an outer perimeter so that the outer perimeter has a substantial appearance of a pedal of a flower, each of the blades of the first set of fan blades and each of the blades of the second set of fan blades having an outer perimeter shaped also to have a substantial appearance of a pedal of a flower.

10. A ceiling fan assembly as defined in claim 6, wherein the first set of blades extend radially and outwardly from the axis a greater distance than the second set of blades.

11. A ceiling fan assembly as defined in claim 6, the assembly further comprising:

a motor housing connected to and simultaneously rotatable with the motor, the first set of blades being connected to and having portions thereof extending radially and outwardly through the motor housing; and a blade housing rotatably connected to the shaft, the second set of blades being connected to and having portions thereof extending radially and outwardly through the blade housing.

12. A method of circulating air, the method comprising:

(a) positioning a ceiling fan assembly having a first set of fan blades connected to a shaft and a second set of fan blades rotatably connected to the shaft a predetermined distance from the first set of fan blades along the shaft in a desired space; and (b) rotating the first set of fan blades in a first rotational direction relative to the shaft, thereby generating air currents that responsively cause simultaneous rotation of the second set of blades in a second rotational direction.

13. A method as defined in claim 12, wherein step (a) further comprises providing a motor rotatably mounted to the shaft and connected to the first set of blades; and wherein step (b) comprises operating the motor to rotate the first set of blades relative to the shaft in a first rotational direction.

14. A method as defined in claim 12, wherein the first set of blades extend radially and outwardly from the shaft a greater distance than the second set of blades.

15. A method as defined in claim 12, wherein a lower surface of each blade of the first set of blades has blade indicia formed thereon so that the simultaneous rotation of the first and second sets of blades of the ceiling fan assembly when mounted to a ceiling and during operation enhancingly provides a substantially blooming flower appearance.

16. A method of driving a ceiling fan assembly, the method comprising:

(a) providing a ceiling fan assembly having a motor rotatably mounted to a shaft, the shaft having an axis extending at least a substantial length thereof, a first set of fan blades connected to the motor, and a second set of fan blades rotatably connected to the shaft a predetermined distance below the motor and the first set of fan blades along the shaft;

(b) mounting the ceiling fan assembly to an extent of a substantially planar support surface such that the axis of the shaft is substantially perpendicular to a horizontal plane of the extent of the substantially planar support surface; and (c) operating the motor to rotate the first set of fan blades in a first rotational direction relative to the axis, thereby generating air currents that responsively cause simultaneous rotation of the second set of blades in a second rotational direction.

17. A method as defined in claim 16, wherein each blade of the first set of blades has a blade body including an upper blade surface and a lower blade surface, the upper blade surface being positioned closer to the extent of the substantially planar support surface than the lower blade surface when the ceiling fan assembly is mounted thereto, the lower blade surface extending in a plane positioned at a preselected angle less than 90 degrees to the horizontal plane, and wherein each blade of the second set of blades has a blade body including an upper blade surface and a lower blade surface, the lower blade surface of each blade of the second set of blades being positioned at a preselected angle less than 90 degees to the horizontal plane and substantially negative to the preselected angle of each blade of the first set of blades so that air current generated during operation of the first set of blades when being driven by the motor and rotating in the first rotational direction responsively causes simultaneous rotation of the second set of blades in the second rotational direction.

18. A method as defined in claim 16, wherein step (a) further comprises:

providing a motor housing connected to and simultaneously rotatable with the motor, the first set of blades being connected to and having portions thereof extending radially and outwardly through the motor housing; and wherein step (c) further comprises operating the motor to rotate the motor housing in a first rotational direction relative to the axis.

19. A method as defined in claim 18, wherein step (a) further comprises:

providing a blade housing rotatably connected to the shaft, the second set of blades being connected to and having portions thereof extending radially and outwardly through the blade housing; and wherein step (c) further comprises rotating the blade housing in a second rotational direction relative to the shaft and opposite to the first rotational direction responsive to air currents generated by rotation of the first set of blades in the first rotational direction when the motor operates.

20. A method as defined in claim 16, wherein the first set of blades extend radially and outwardly from the axis a greater distance than the second set of blades.

21. A method as defined in claim 20, wherein a lower surface of each blade of the first set of blades has blade indicia formed thereon so that the simultaneous rotation of the first and second sets of blades of the ceiling fan assembly when mounted to the extent of substantially planar support surface and during operation enhancingly provides a substantially blooming flower appearance.

* * * * *